US006663304B2

(12) United States Patent
Vives et al.

(10) Patent No.: US 6,663,304 B2
(45) Date of Patent: Dec. 16, 2003

(54) SIMULTANEOUSLY PRINTING INFORMATION ON TWO SIDES OF PRINT MEDIA

(75) Inventors: Juan C. Vives, San Diego, CA (US); Josep Maria Serra, San Diego, CA (US); Kurt Eugene Thiessen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 38 days.

(21) Appl. No.: 10/060,834

(22) Filed: Jan. 30, 2002

(65) Prior Publication Data

US 2003/0143007 A1 Jul. 31, 2003

(51) Int. Cl.[7] ..... B41J 3/54; B41J 3/00; B41F 1/44; B41F 13/02; B41F 5/02

(52) U.S. Cl. ..... 400/82; 101/332; 101/223; 101/211; 101/230; 101/229; 347/4; 347/5; 347/37

(58) Field of Search ..... 400/82; 347/37, 347/4, 5; 101/332, 223, 211, 230, 229; 399/384, 389

(56) References Cited

U.S. PATENT DOCUMENTS

| | | | | | |
|---|---|---|---|---|---|
| 3,995,553 | A | | 12/1976 | Winterholler et al. | 101/228 |
| 4,475,128 | A | * | 10/1984 | Koumura | 358/296 |
| 4,832,244 | A | * | 5/1989 | Moriya | 226/115 |
| 5,101,224 | A | * | 3/1992 | Freed, Jr. | 346/145 |
| 5,160,505 | A | | 11/1992 | Seveno et al. | 8/471 |
| 5,243,394 | A | | 9/1993 | Matsuno et al. | 399/2 |
| 5,326,674 | A | | 7/1994 | Toyama et al. | 430/325 |
| 5,406,314 | A | | 4/1995 | Kuehnle | 347/115 |
| 5,456,539 | A | * | 10/1995 | Wright et al. | 400/82 |
| 5,467,179 | A | * | 11/1995 | Boeck et al. | 399/384 |
| 5,526,107 | A | * | 6/1996 | Bronstein | 399/299 |
| 5,548,390 | A | | 8/1996 | Sugisaki et al. | 399/364 |
| 5,552,817 | A | | 9/1996 | Kuehnle | 347/115 |
| 5,577,367 | A | | 11/1996 | Abrams et al. | 53/425 |
| 5,581,290 | A | | 12/1996 | Kuehnle | 347/115 |
| 5,670,995 | A | | 9/1997 | Kupcho et al. | 347/5 |
| 5,699,494 | A | * | 12/1997 | Colbert et al. | 358/1.15 |
| 5,727,135 | A | | 3/1998 | Webb et al. | 358/1.14 |
| 5,751,308 | A | | 5/1998 | Gandy et al. | 347/33 |
| 5,778,297 | A | * | 7/1998 | Reichl et al. | 399/384 |
| 5,801,721 | A | * | 9/1998 | Gandy et al. | 347/3 |
| 5,839,047 | A | | 11/1998 | Hirabayashi et al. | 399/389 |
| 5,933,676 | A | | 8/1999 | Ohno | 399/8 |
| 5,966,503 | A | | 10/1999 | van Vliembergen et al. | 358/1.6 |
| 5,982,994 | A | * | 11/1999 | Mori et al. | 358/1.15 |
| 6,013,123 | A | | 1/2000 | Scarpetti | 106/31.27 |
| 6,035,308 | A | | 3/2000 | Yano et al. | 715/501.1 |
| 6,038,376 | A | | 3/2000 | Noguchi | 358/1.15 |
| 6,041,205 | A | | 3/2000 | Funada et al. | 399/196 |
| 6,048,115 | A | | 4/2000 | Unishi et al. | 400/74 |
| 6,055,408 | A | * | 4/2000 | Creutzmann et al. | 399/384 |
| 6,088,546 | A | | 7/2000 | Inoue et al. | 399/45 |
| 6,142,622 | A | * | 11/2000 | Blanchard et al. | 347/104 |
| 6,190,070 | B1 | | 2/2001 | Urban et al. | 400/636.3 |
| 6,192,204 | B1 | | 2/2001 | Yagi et al. | 399/66 |
| 6,204,932 | B1 | | 3/2001 | Haneda et al. | 358/1.9 |
| 6,227,110 | B1 | | 5/2001 | Zlatin | 101/218 |
| 6,250,548 | B1 | | 6/2001 | McClure et al. | 235/51 |
| 6,293,650 | B1 | * | 9/2001 | Sette et al. | 347/37 |
| 6,477,950 | B1 | * | 11/2002 | Feilen et al. | 101/230 |

* cited by examiner

*Primary Examiner*—Andrew H. Hirshfeld
*Assistant Examiner*—Wasseem H. Hamdan

(57) ABSTRACT

A method, printer system and printer apparatus for simultaneously printing a first print medium and a second print medium, wherein, on the first print medium first information is printed that is one of: identical information to the second information and information that includes at least some information different from the second information that is printed on the second print medium.

2 Claims, 5 Drawing Sheets

SIMULTANEOUSLY PRINTING INFORMATION ON TWO SIDES OF PRINT MEDIA

BACKGROUND OF THE INVENTION

The present invention relates to printers, and more particularly, to printers having a capability of simultaneously printing on two sides of a medium.

As more people have begun utilizing printers, prices have dropped, and printers have become even more available for small business uses. Typically, printers print on one side of a medium in accordance with signals from a computing device. The computing device may be a desktop printer, an electronic cash register, a hand held device, or the like.

Printers such as daisy/inkjet/laser printers have been limited to printing on one side of a printing medium. In such a system, in order to print on both sides of the print medium, the print medium must be flipped over manually or alternatively, a mechanical multiplexing or duplexing device may be used to turn the print medium over.

SUMMARY OF THE INVENTION

The present invention provides a method, printer system and printer apparatus for simultaneously printing on a first print medium and a second print medium, wherein, on the first print medium first information is printed that is one of: identical to second information printed on the second print medium and has information different from second information printed on the second print medium.

DETAILED DESCRIPTION

In some instances it may be helpful to a user to be able to print on both sides of a print medium, for instance, paper which is preferably supplied in a roll format, although individual sheet stock may be more useful in some implementations. In one illustrated embodiment, a user may wish to print two copies, for example, of a receipt, simultaneously to speed printing time. Sometimes, different information may be printed on the two sides of the same medium, or on one side of each of two media that are fed through the printing system at the same time. Sometimes, the information may be related, but may serve slightly different needs. For example, if two separate copies are being printed for a purchase to be charged to a credit card, a first copy may need to provide a line for signature by the person charging the purchase, which copy would be kept by the seller, and the second copy may be provided to the purchaser as the receipt, and thus not include a line for signature. In addition, where information may be printed on both sides of a receipt, form or the like, for instance, when printing purchase information on one side and coupons on the opposite side, only half as much paper or other print medium is used, contributing to savings in materials usage.

Figure 1:
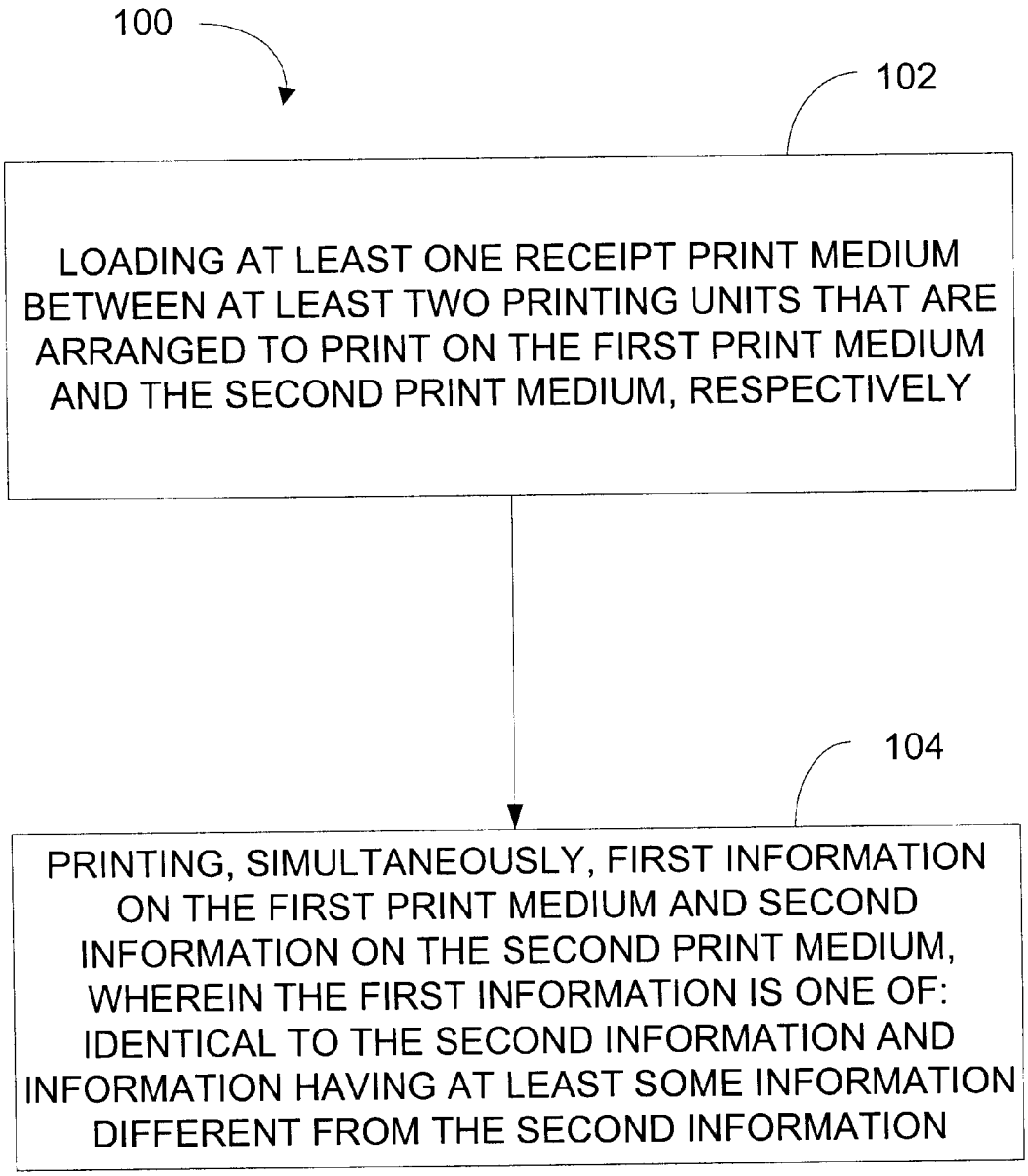
FIG. 1 is a flow chart showing one embodiment of steps in accordance with the method of the present invention.

FIG. 1 illustrates one form of a printing method 100 for simultaneously printing on a first print medium and on a second print medium, wherein, on the first print medium the information printed may be identical to the information on the second medium or at least some information printed on the first medium may be different from information printed on the second print medium. As shown in FIG. 1, first, at least one print medium is loaded 102 between at least two printing units that are arranged to print on the first print medium and the second print medium simultaneously, respectively. For example, the print medium may be a size to accommodate a receipt, a coupon, a label or the like. Then, the at least two printing units are utilized for printing 104, simultaneously, first information on the first print medium and second information on the second print medium, wherein the first information may be the same as the second information, or the first information may have at least some information different from the second information. Generally, two printing units may be used to print a front side and a back side of a material used for a single print medium, or alternatively, where two print media are fed together, in synchrony, from two different sources, the two printing units may be used to print first information and second information, respectively, on a single side of each of the two print media. "Synchrony" includes both media advancing at the same speed through printzones (see 250, 252 of FIG. 2). Alternatively, in some implementations, it may be preferable to advance the media at different feed rates through the printzones 250, 252, for instance to enable drying of the more saturated media such as one bearing full color coupons, as opposed to a lesser saturated media, such as one bearing only text. Where desired, more than two printing units may be utilized, wherein the additional printing units each may provide a different color ink for printing. Typically, a printing unit for each side of the printing media contains black ink and any separate printing unit for each side contains a selected colored ink other than black or a tricolor cartridge such as one containing cyan, magenta and yellow inks.

A printing unit, for example, may be implemented using inkjet technology with thermal or piezo-electric printheads. An inkjet cartridge or an inkjet printhead may receive ink from an "off-axis" or remote supply. Electro-photography techniques, such as those used in laser printing, may also be utilized. In an "off-axis" system, the printheads carry only a small ink supply across the printzone, with this supply being replenished, for example through tubing that delivers ink from an "off-axis" main reservoir placed at a remote, stationary location within the printer. Rather than purchasing an entire new cartridge which includes a costly new printhead, the consumer buys only a new supply of ink for the main reservoir. Typically, the fresh ink supplies are sold individually by color, although in some implementations, a multi-color supply may be furnished.

While printheads in an "off-axis" system may be called "permanent" printheads, in reality such printheads usually have a somewhat shorter life span than the other components of the printer and typically do need replacement at some point to maintain high print quality. Thus, the term used herein to distinguish the "off-axis" printheads is "semi-permanent," in contrast to the printheads in a replaceable cartridge system. Indeed, this term "semi-permanent" for the printheads even more broadly encompasses what are known in the art as "snapper" systems, which detachably "snap" a fresh supply onto a printhead-carrying carriage, then transport this detachable supply across the printzone. The printheads in a "snapper" system may also be "permanent" or capable of replacement during the life of the printer, i.e., "semi-permanent." Another way of distinguishing the "off-axis" and "snapper" systems from the totally replaceable cartridge system is the attachable/detachable or removable engagement of the printhead from the reservoir in the "off-axis" or "snapper" systems. It is apparent to those skilled in the art that the simultaneous two-sided printing systems described herein are clearly operable in the "off-axis" and "snapper" systems as well as other ink delivery systems.

Figure 2:
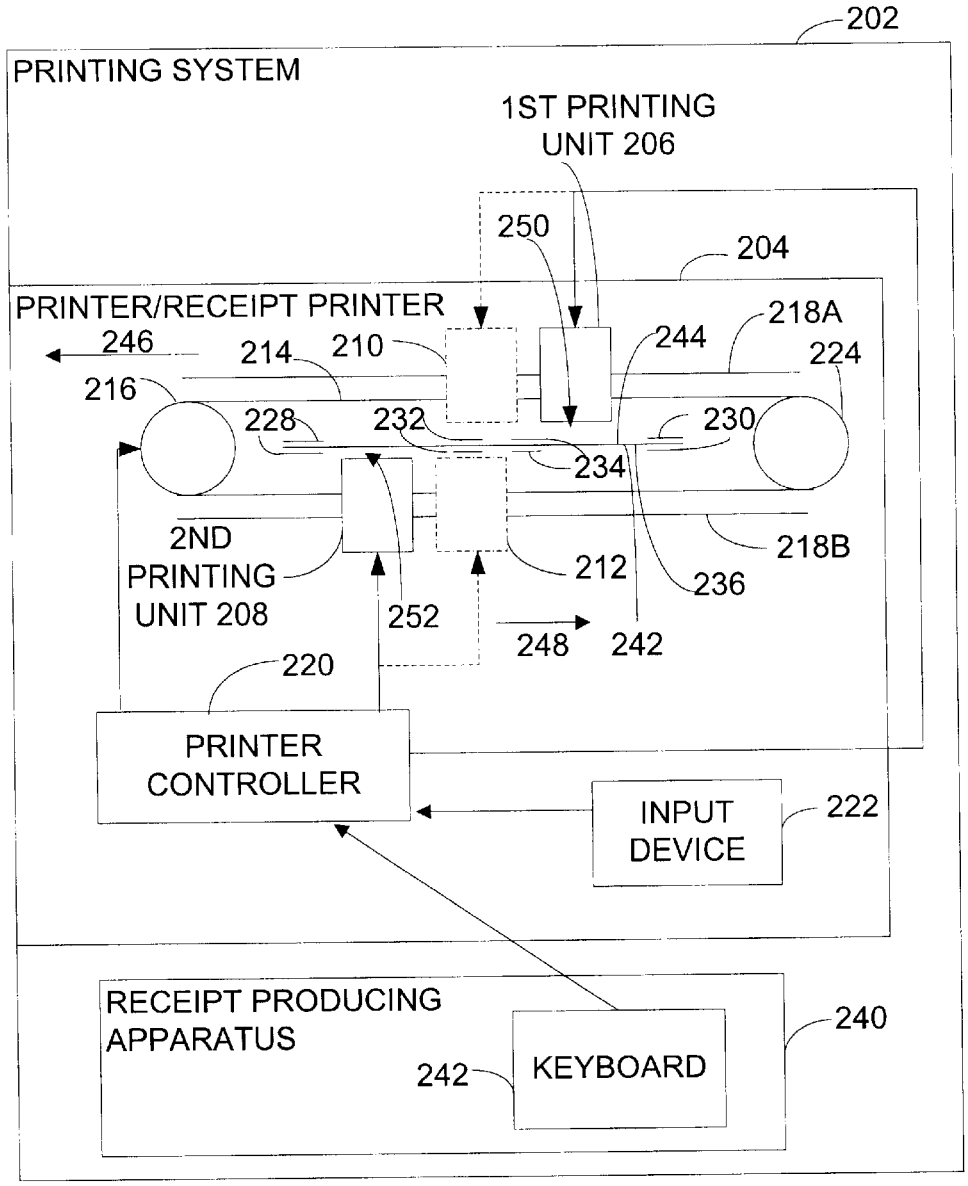
FIG. 2 is a block diagram of a printer system in accordance with one embodiment of the present invention.

As shown in FIG. 2, in one embodiment, the at least two printing units such as 206, 208, and optionally units 210, 212 (shown in dashed lines) are disposed on an oblong belt 214 which may be driven on a set of two pulleys 216, 224 arranged around the printing media 236, so that the printing units 206, 208, 210, 212 travel on a track 218A, 218B in the direction of pulley movement, such as that indicated by arrows 246, 248 while printing first information on the one surface 242 of the print medium and second information on the opposing surface 244 of the print medium. Alternatively, rather than using reciprocating printheads 206–212, a single stationary page-wide array ("PWA") printhead may be placed on each side of the media, with one PWA printhead replacing units 206, 210, and the other PWA printhead replacing print units 208, 212. The stationary nature of such PWA printheads would eliminate the pulley and belt drive system required to propel the reciprocating print units 206–212, assuming the PWA printheads were sized to extend across the width of the media.

When instructions are entered via the keyboard 242 or alternatively, via an input device 222 such as a computer, the printer controller 220 initiates movement of the first printing unit 206 and the second printing unit 208 (and, where utilized, other printing units such as 210, 212) by sending control signals to a motor driving a pulley 216. The printing units 206, 208 are attached to the belt 214 and move along the tracks 218A, 218B as the belt 214 moves.

Thus, printing is accomplished in two zones 250, 252, one zone being an area 250 wherein the first printing unit 206 prints, and the other zone being an area 252 wherein the second printing unit 208 prints. For example, the first printing unit 206 may print on one surface 242 of a print medium, and the second printing unit 208 may print on the opposing surface 244 of the print medium. Where two print media are fed thorough the printing system together (see FIG. 3), the two outward-facing surfaces of the print media 242', 244' are printed.

Where desired, the first print medium 236 and the second print medium 238 (see FIG. 3) for printing receipts, forms or the like may have a width in a range of about 1 centimeter to 21 centimeters. Other widths may be selected for particular uses.

Thus, a receipt printer 204 may simultaneously print on a first print medium 236 and a second print medium 238 and may comprise a first printing unit 206 and a second printing unit 208, opposed to one another and each coupled to a print controller 220 that controls simultaneously printing, by the first 206 and second 208 printing units, on the first print medium and the second print medium, respectively. For example, tickets for different movies and different shows may have different coupons printed on the backs of the tickets. In one embodiment, theater tickets, such as movie theater tickets may be printed on a narrow-width medium such as, for example, about 1 to 21 centimeters in width.

As shown in FIG. 2, the present invention also includes a printing system 202 for printing on a first print medium 236 and on a second print medium 238, wherein, on the first print medium 236 first information printed is one of: substantially the same as second information printed on the second print medium 238, or is different from second information printed on the second print medium 238. For example, a receipt may be printed on the first print medium 236 to show the items and the amount charged for each item as well as the total amount due, while at the same time a second receipt may be printed on the second print medium 238 that shows the items, amount charged for each item and may include a line for the buyer to sign so that the purchase is charged to a credit card. In another embodiment, a store may print a receipt on one surface of the print medium 242 and coupons on the opposing surface 244. Thus, the printing may be accomplished on the two opposing surfaces of a single print medium, or alternatively, may each be accomplished on one side of each of two print media 236, 238 that are fed through the print zones 250, 252 together. In one embodiment, the printing system 202 includes at least one print medium feed unit 302 having at least one roller 312, shown in FIG. 3, optional second print medium feed unit 304, each print medium feed unit having a print medium or media installed thereon. The two print media 236, 238 are printed on the outward facing surfaces 242', 244'. The print medium feed units 302, 304 with a supply of roll print media mounted thereon are coupled to a printer controller 220 and are arranged to load the print medium within a media feed path leading to and through the print zones 250, 252 for printing by at least one printing unit 206 (optional printing units 208, 210, 212) that is arranged to print on the a surface 244 of the print medium 236. As is known in the art, the receipts may be separated from the roll by manually applying pressure against a serated edge (not shown), cutting by an automatic cutting device (not shown) or the like. The printing system 202 also includes a printer 204 having the at least one printing unit 206 (optional printing units 208, 210, 212) disposed therein. The printer controller 220 is coupled to the at least one printer unit 206 (and where optional printing units 208, 210, 212 are utilized, is coupled to the optional printing units) and to at least one print medium feed unit 302. In addition, the printer controller 220 is coupled to two sets of feed controllers such as pressure (pinch) rollers 306, 308 (shown in FIG. 3) that are arranged for controlling print medium feed when printing, simultaneously, first information on the first print medium 236 and second information on the second print medium 238. The feed controllers may also be configured to provide tractor feed or other media movement mechanisms known to those skilled in the art. Typically, print media guides 228, 230, as shown in FIG. 2, may be disposed between the pulleys 216, 224 to guide the print media.

The printing unit 206 and optional printing units 208, 210, 212 may travel along a drive belt driven by a drive pulley 216 and stabilized by an idler pulley 224 to facilitate printing on the first print medium and to allow printing on the second print medium. Also, the first information and the second information may be printed on print media from two sources, wherein the print media are juxtaposed (see FIG. 3, wherein two print media 236, 238 may be adjacent or may be overlapped partially or completely, typically with a front surface of the first print medium facing in an opposite direction with respect to the front surface of the second print medium), each of the print media having at least one printing unit arranged to print thereon. In this embodiment, typically, additional print media guides 232, 234 may be disposed between the pulleys to guide the print media. An input device 222 such as, for example, a computer, may be used to input the first information and the second information into the printer controller 220, which then forwards the first information and the second information to the desired printing unit 206, 208, 210, 212. In one embodiment, the at least one printing unit may include two printing units, one printing unit dispensing/ejecting black ink and one printing unit dispensing/ejecting ink of at least one other color(and where desired, another optional color printing unit 212). For instance, a company's logo may include one particular color, which is supplied by unit 210.

Thus, FIG. 2 shows a printing system 202 for simultaneously printing on a first surface 242 and an opposing surface 244 of a print medium 236 wherein the printing system includes a receipt producing apparatus 240, coupled to a receipt printer 204. The printing system 202 includes a keyboard 242 that is coupled to the printer controller 220 for sending instructions for printing a two-sided receipt to the receipt printer 204. The receipt printer 204 is coupled to the receipt producing apparatus 240 for simultaneously printing the receipt on both sides. In one embodiment, the receipt printing apparatus 240 is a cash register. The receipt may, for example, have a width in a of 1 centimeter to 21 centimeters.

Figure 3:
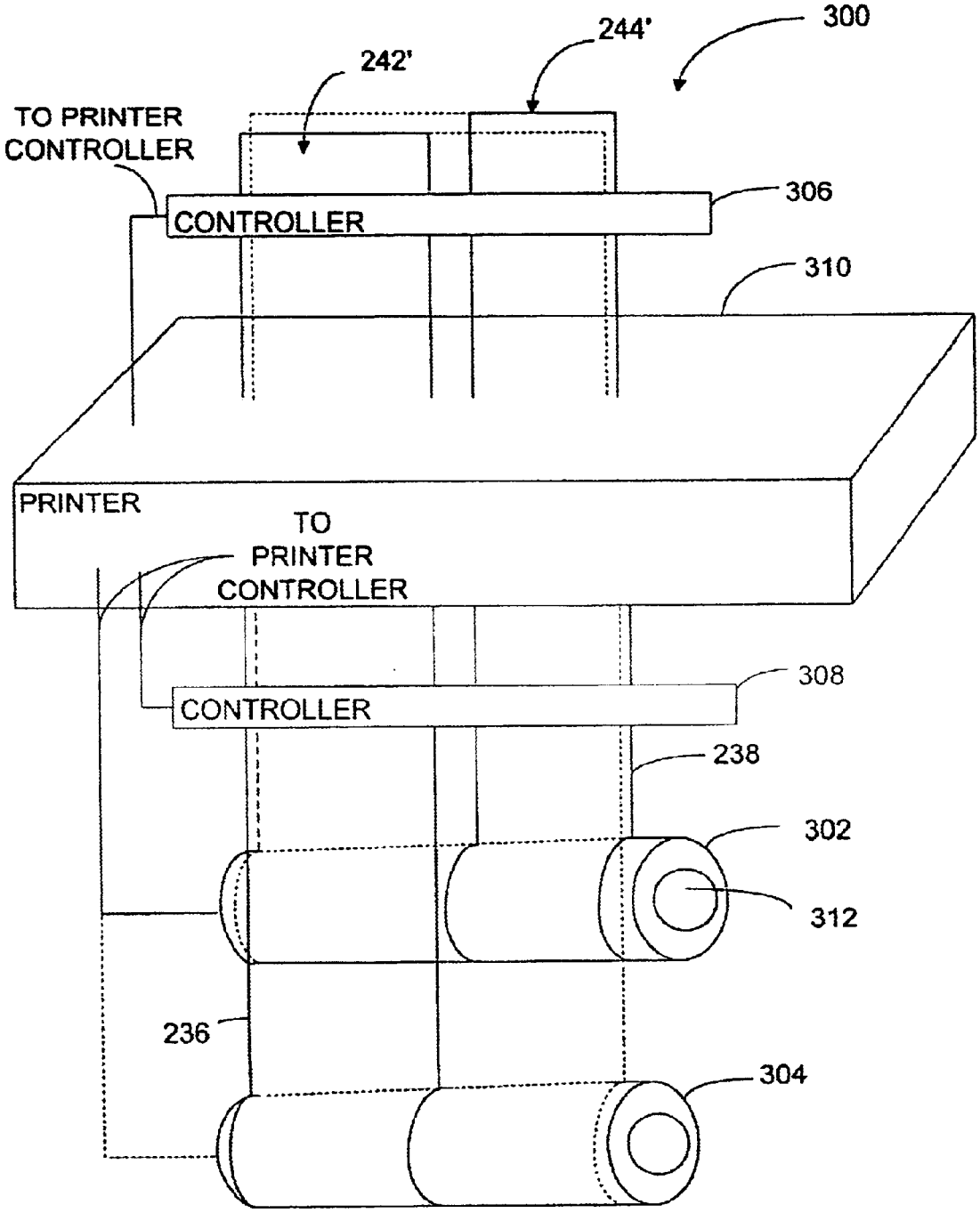
FIG. 3 is a perspective drawing of a printer system in accordance with the present invention, showing one embodiment of print medium input.

As shown in FIG. 3, the present invention may be embodied in a dual side printing apparatus 300 for printing a first print medium 236 and a second print medium 238 simultaneously. The information printed on the first print medium 236 may be the same as the information printed on the second print medium or may have at least some information that is different from information printed on the second print medium 238. The at least one print medium feed unit 302 includes a roller 312 with the at least one print medium 238 disposed thereon and is coupled to the printer controller (inside printer 310, printer controller not shown in FIG. 3). The at least one print medium feed unit 302, 304 may include a first print medium feed unit 302 that is arranged to load the at least one print medium 238 wherein at least two printing units 206, 208 are arranged to print on one surface 242 and the opposing surface 244 of the print medium, respectively (shown in FIG. 2). A second print medium feed unit 304 may be arranged to feed a second print medium 236 into the printer 310. The printer 310, shown with more particularity in FIG. 2, may have at least two printing units 206, 208 disposed therein. Where desired, different colors or types of print media may be utilized for the two print medium feed units 302, 304, such as white for a seller's copy and yellow for a buyer's copy.

A printer controller 220, shown in FIG. 2, may be coupled to the printer units 206, 208 and to the print medium feed unit 302 (and optionally to print medium feed unit 304) and to two sets of feed controllers 306, 308 such as pressure rollers for controlling print medium feed. The printer 226 is arranged for printing, in one printing operation, first information on the first print medium and second information on a second print medium, wherein the first information either is the same as the second information or, if desired, has at least some information different from the second information. The first print medium may be a first side of a material being printed, and the second print medium may be a second/opposing side of the material being printed, or alternatively, the first print medium and second print medium may be opposing outer sides of two print media, arranged together and being printed. In one embodiment, where the first information and the second information are printed on print media from two print medium feed units 302, 304, the print media 236, 238 may be disposed together between two printing units such as 206, 208 and may be fed with both media 236, 238 advancing at the same speed through print zones 250 and 252. Alternatively, in some implementations, it may be preferable to advance the media 236 and 238 at different feed rates as described above. The print media may also be disposed side by side between the printing units 206, 208, as described with greater particularity above. The colors of ink for the printing units are selectable. That is, any desired color of ink may be utilized in each printing unit. For example, one printing unit may contain black ink, and a second printing unit may contain another color of ink.

Figure 4:
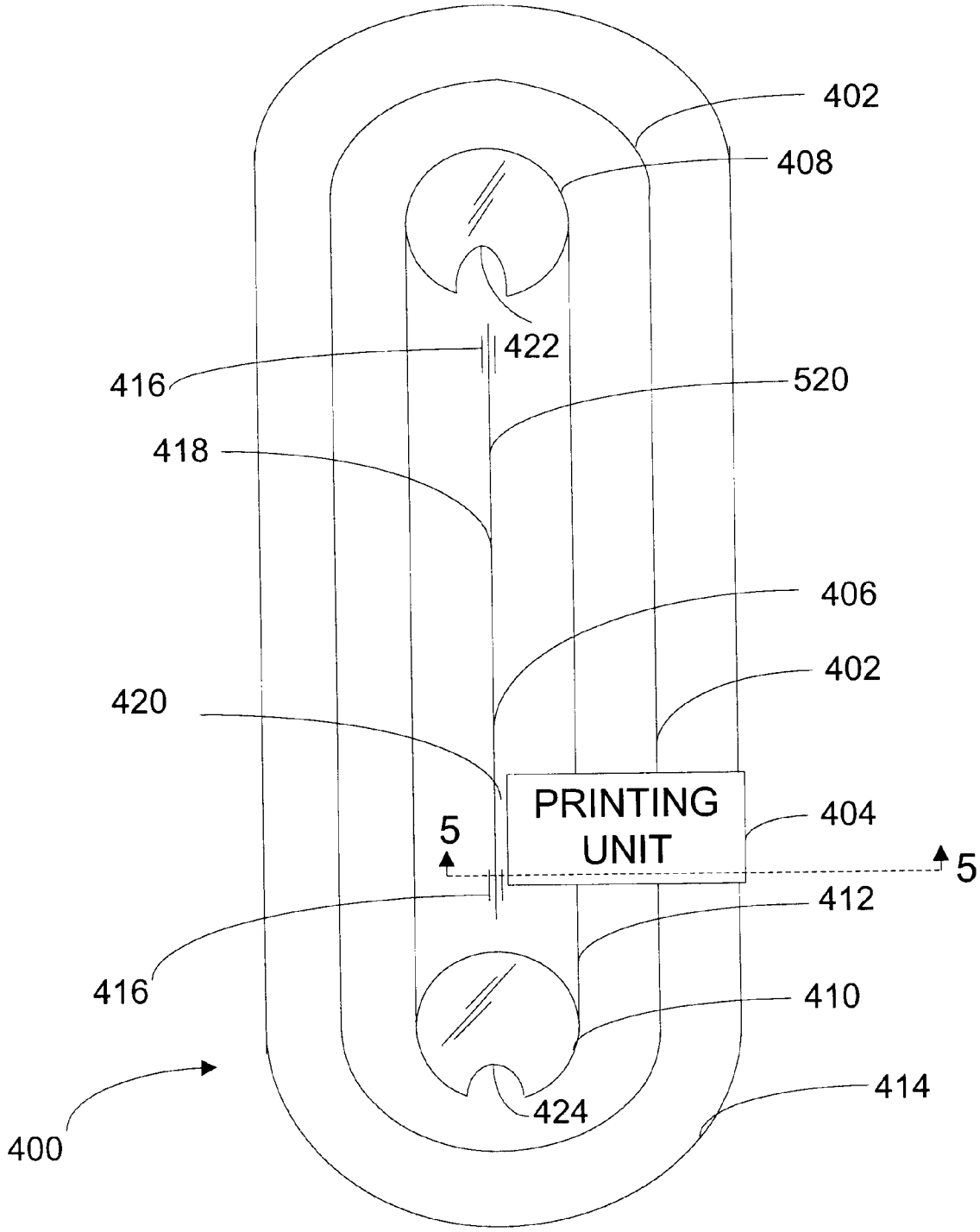
FIG. 4 is a block diagram of another embodiment of a printer apparatus for a printer system in accordance with the present invention.
Figure 5:
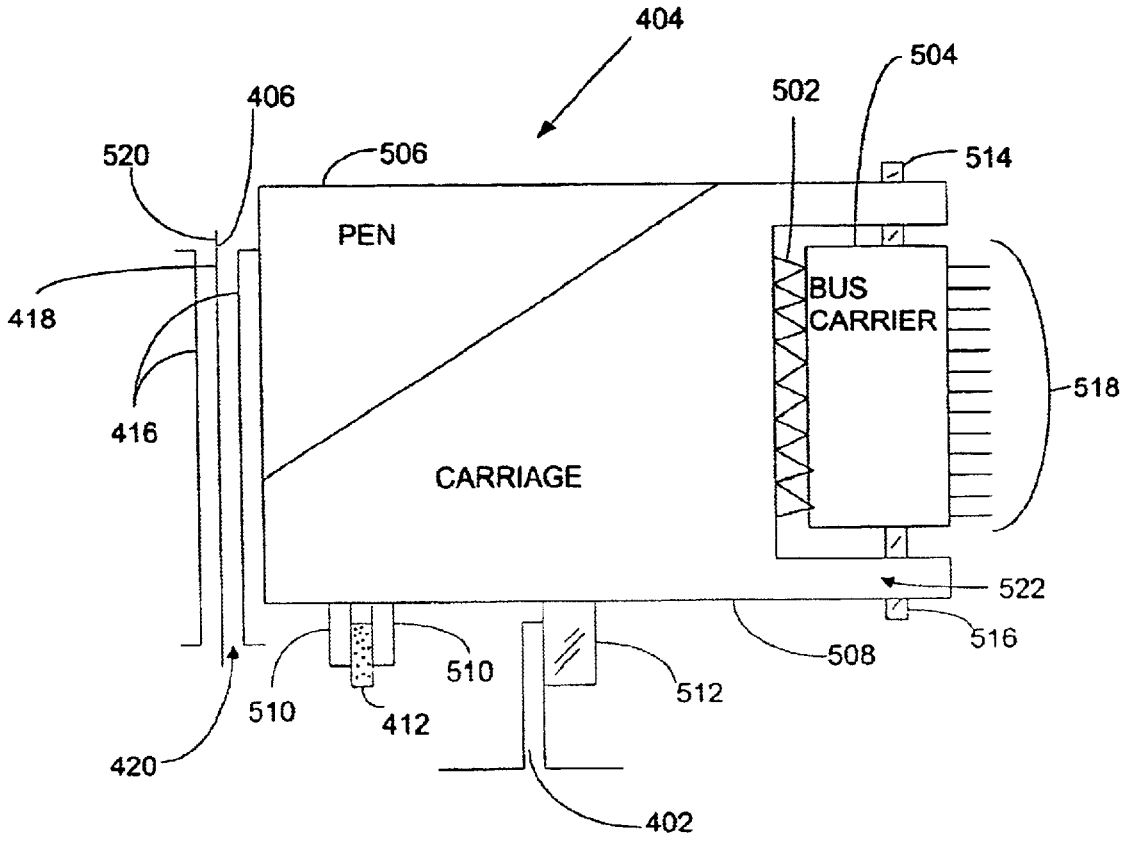
FIG. 5 is an enlarged, side elevational view taken along lines 5—5 of FIG. 4.

FIG. 4 shows an alternate embodiment of a printer apparatus 400 which may use a carriage support or track 402 to carry printing units 404 or cartridges. The printing unit 404 or units run on the carriage track 402, which surrounds the print medium front 406 and back 418 print surfaces. The continuous carriage track 402 runs parallel to the print medium front 406 and back 418 print surfaces with a half circle at either end of the print medium as the carriage track 402 proceeds around a drive pulley 408 and an idler pulley 410 that advance a carriage drive belt 412. The carriage drive belt 412 is driven by the drive pulley 408 connected to a motor (not shown). The idler pulley 410 is preferably used to provide tension opposite the drive pulley 408. The carriage drive belt 412 parallels the carriage track 402. The drive belt 412 is connected to the printing unit 404 via two posts (see FIG. 5, 510) on the bottom of the printing unit 404, which pinch the drive belt 412 and mate to ribs (not shown) on the drive belt 412. Preferably, there are notches 422, 424 on the drive pulley 408 and the idler pulley 410 that allow the belt attachment posts to pass through the pulleys 408, 410 smoothly. Power bus lines 414 lie in a concentric track around track 402. The front surface 406 of the print medium passes through the print zone 420, the printing unit 404 prints the desired information. As shown in FIG. 5, which is a side cutaway view of a block diagram of the printing unit 404 and the print medium 520 being fed centrally with respect to the carriage track 402 in accordance with the present invention, the printing unit 404 may be electrically connected to drive circuitry (not shown) via brushes 502 extending from the rear of the printing unit 404. The brushes 502 ride in grooves (not shown) in a bus carrier 504, which is coupled to power bus lines 518 that provide power for firing selected resistors to cause ink ejection from associated nozzles within the printing unit 404. The power bus lines 518 form another concentric track around the track 402. The print medium 520, such as paper, for example, may be one or two sheets thick, and may be fed through from below the carriage track 402 by feed controllers 306, 308 such as the pressure rollers. The print medium 520 may be guided past the printing unit 404 via thin parallel guides 416. The printing unit 404 generally includes a pen 506 disposed in a carriage 508. The carriage 508 has the two posts 510 (described above) that pinch the drive belt 412 and a roller 512 disposed proximate to the two posts, wherein the roller 512 supports and guides the printing unit 404 along the carriage track 402. The rear 522 of the printing unit 404, i.e., the portion of the printing unit 404 directly opposite the portion which prints on the print medium, has a substantially "C" shape, with a roller 514 at the top of the "C" and a roller 516 at the bottom of the "C", wherein the rollers 514, 516 facilitate connection of the printing unit 404 with the bus carrier 504 as the printing unit 404 travels along the carnage track 402. Where desired, the print medium 520 may be fed from above the printing unit 404. Also, if desired, additional drive rollers may be added above the printing unit track 402 (e.g., see FIG. 3) for additional print medium control. Print medium guides 416 aid in guiding the print medium 520 through the print zones 250, 252.

Clearly, a printing unit 404 may be a composite of a carriage 508 plus at least one pen 506. Where a printing unit 404 includes a page-wide printing array, the printing unit 404 may be stationary. In some embodiments, a single carriage 508 may hold multiple black pens to speed printing also.

Thus, examples of a method, printer system and printer apparatus have been described according to the present invention. Many modifications and variations may be made to the techniques and structures described and illustrated herein without departing from the spirit and scope of the invention. Accordingly, it should be understood that the method, printer system, and printer apparatus described herein are illustrative only and are not limiting upon the scope of the invention.

What is claimed is:

1. A system for simultaneously printing first information on a first medium and second information on a second medium, wherein the second information is identical to or different from the first information, the system comprising:

at least one print medium feed unit adapted to have at least one print medium disposed thereon, coupled to a printer controller and arranged to load the at least one print medium within a path for printing by at least one printing unit that is arranged to print on the first print medium and the second print medium; and a printer having:

the at least one printing unit disposed therein and arranged to print on the first print medium and the second print medium; and the printer controller coupled to an input device, the at least one printer unit, the at least one print medium feed unit, and two feed controllers for controlling print medium feed, wherein the printer is arranged for printing, simultaneously, first information on the first print medium and second information on the second print medium;

wherein the at least one printing unit comprises one printing unit that, when printing, travels along a drive system defining opposing first and second printzones located on opposite sides of a print medium loaded therebetween; and further including a drive system that comprises a drive belt driven by a drive pulley and stabilized by an idler pulley wherein the drive pulley and the idler pulley each include a means for permitting the printing unit to print on the first print medium, pass around a next pulley and print on the second print medium.

2. The system of claim 1 wherein the means for permitting the printing unit to print on the first print medium, pass around a next pulley and print on the second print medium is a notch.

* * * * *

UNITED STATES PATENT AND TRADEMARK OFFICE

CERTIFICATE OF CORRECTION

PATENT NO. : 6,663,304 B2
DATED : December 16, 2003
INVENTOR(S) : Vives et al.

It is certified that error appears in the above-identified patent and that said Letters Patent is hereby corrected as shown below:

Column 6,
Line 66, delete “carnage” and insert in lieu thereof -- carriage --.

Signed and Sealed this

Second Day of November, 2004

JON W. DUDAS
*Director of the United States Patent and Trademark Office*